United States Patent [19]

Kolter

[11] 4,372,182

[45] Feb. 8, 1983

[54] WIRE WRAP REMOVING TOOL

[76] Inventor: Gary L. Kolter, Box 4900 New River Stage, Phoenix, Ariz. 85029

[21] Appl. No.: 225,685

[22] Filed: Jan. 16, 1981

[51] Int. Cl.[3] ..... B25B 7/02

[52] U.S. Cl. ..... 81/426; 29/268

[58] Field of Search ..... 81/426, 425 R, 425 A, 81/418, 5.1 R; 29/264, 229, 268

[56] References Cited

U.S. PATENT DOCUMENTS

| | | | |
|---|---|---|---|
| 891,509 | 6/1908 | Tanner | 81/425 R |
| 908,947 | 1/1909 | Burkhart | 81/425 R |
| 1,435,150 | 11/1922 | Carpenter | 81/5.1 R |
| 1,578,816 | 3/1926 | Eifried | 81/418 |
| 1,792,837 | 2/1931 | Harrison | 81/5.1 R |
| 2,700,910 | 2/1955 | Van Niel | 81/5.1 R |
| 4,149,435 | 4/1979 | Smith | 81/5.1 R |

*Primary Examiner*—James L. Jones, Jr.

*Attorney, Agent, or Firm*—Cahill, Sutton & Thomas

[57] ABSTRACT

A tool removes a wrapped wire conductor from a terminal pin by distorting the configuration of the wire wrap to lessen the frictional contact between the wire wrap and the terminal pin longitudinal edges to permit sliding of the wire wrap along and from the terminal pin.

1 Claim, 9 Drawing Figures

WIRE WRAP REMOVING TOOL

The present invention relates to hand tools and, more particularly, to hand tools for use in the electrical arts.

Some terminal boards of electrical apparatus include one or more rows of terminal pins extending from a base. Electrical conductors or wires are often attached to these terminal pins by wrapping the wire thereabout to form a helical coil in frictional engagement with the terminal pin. Various tools have been developed to accomplish such wrapping. In example, U.S. Pat. No. 4,195,401 describes a tool having a slotted hollow tubular end for internally receiving the terminal pin and wrapping the wire thereabout as the tool is rotated about its longitudinal axis.

Various hand tools have also been developed to remove a wrapped wire from about a terminal pin. In example, U.S. Pat. No. 2,898,952 describes a hand tool having a pair of jaws with inscribed screw threaded depressions on facing surfaces of the jaws for gripping on existing wire wrap. By twisting the tool about the longitudinal axis of the wrapped terminal, the wire wrap can be loosened for removal or tightened to reestablish the wire wrap about the terminal pin. U.S. Pat. No. 2,998,034 is directed to a tool for grasping a wire of an existing wire wrap and unwrapping it through rotation of the tool about the longitudinal axis of the wire wrap. Various other tools such as needle nose pliers may also be employed which simply grasp a free end of the wire wrap and by appropriate manipulation of the tool results in partial or complete unwinding of the wire wrap to effect disengagement with a terminal pin.

As will be evident from the above review of the pertinent prior art, all of the devices require more or less unwrapping of the wire wrap to permit disengagement with the terminal pin. Such unwrapping is labor intensive, time consuming and therefore expensive. It may be noted that on a fair sized terminal board, several hundred wire wrapped terminal pins may exist.

Various plier-like tools have been developed for certain specialized operations. In example, U.S. Pat. No. 129,496 describes a pair of pliers wherein one jaw is slotted to accommodate the post of a shoe fastening during attachment of the shoe fastening. The device disclosed in U.S. Pat. No. 362,981 has a pair of jaws each of which includes a terminal end oriented 90° toward the other and one of which is slotted. The pair of pliers illustrated in U.S. Pat. No. 1,141,916 illustrates a pair of tangs of one jaw intermediate which a tang of the other jaw is oriented to effect bending of a wire disposed therebetween. The pliers described in U.S. Pat. No. 1,751,165 include a first jaw which includes a slotted opening for receiving a second jaw. U.S. Pat. No. 2,700,910 discloses a pair of pliers for removing a spring nut by disengaging the tongues of the spring nut from the post disposed therebetween. The pair of pliers disclosed in U.S. Pat. No. 3,191,840 is particularly adapted for removing a split end spring which spring maintains the two ends of a roller chain in engagement with one another. U.S. Pat. No. 3,911,583 discloses a pair of dental pliers having jaws particularly adapted for engaging tooth mounted metal bands and removing same from about the teeth. The pair of pliers illustrated in U.S. Pat. No. 4,149,435 effectively punches out the knockout identification slug from a key.

It is therefore a primary object of the present invention to provide a tool for removing a wire wrapped about a terminal pin without partial or complete unwrapping of the wire.

Another object of the present invention is to provide a tool for quickly and easily loosening a wrapped wire from a terminal pin to permit removal of the wire.

Still another object of the present invention is to provide a tool for distending a wrapped wire without unwrapping it to reduce its frictional contact with an engaged terminal pin.

Yet another object of the present invention is to provide a tool for reducing the frictional contact intermediate a wrapped wire and a terminal pin and urging the wrapped wire into slidable disengagement with the terminal pin.

A further object of the present invention is to provide a tool for removing a wrapped wire from a terminal pin in confined quarters.

A still further purpose of the present invention is to provide a pair of pliers specially configured to grasp and remove a wire wrap from about a terminal pin without twisting the wire wrap about the longitudinal axis of the wrap.

A yet further object of the present invention is to provide a pair of pliers having uniquely shaped jaws for distorting the cross-sectional configuration of a helical wire wrap to reduce its frictional contact with a terminal pin.

A yet further object of the present invention is to provide a pair of pliers for loosening a wire wrapped about a supporting terminal pin and withdrawing the wire wrap from the terminal pin.

These and other objects of the present invention will become apparent to those skilled in the art from the description of the invention below.

Most terminal pins or posts about which single conductor electrical wire is wrapped are rectangular in cross-section. Upon wrapping of the wire, the cross-section of the resulting helix is elliptical, elliptical-like or oval wherein the contact points between the wire wrap and the terminal pin are coincident with the longitudinal edges of the terminal pin. Intermediate the edges, the wire wrap is essentially not in contact with the terminal pin surfaces. Upon squeezing of the wire wrap at opposed points intermediate adjacent edges of the terminal pin, the resulting deformation of the helical wrap reduces the force by which the wire wrap is in engagement with each of the edges. The reduced force and hence the friction intermediate the wire wrap and the terminal pin is consequently substantially reduced. The reduced frictional contact will permit lifting of the wire wrap off of the terminal pin provided that such lifting is effected by applying an upward force at the bottom of the helical wrap.

The present invention is a tool like a pair of pliers and having jaws particularly configured to cause deformation of a helically wrapped wire to reduce its frictional contact with an encircled terminal pin and includes means for lifting the wire wrap off the terminal pin. Particularly, the inner surface of one jaw includes a planar surface for bearing against one side of the wire wrap. The inside surface of the opposing jaw includes a depression extending from the tip end of a width generally coincident with the width of the terminal pin. A bifurcated or split foot extends laterally from the jaw to straddle the terminal pin and engage the lowermost coil of the wire wrap helix upon upward movement of the pliers.

In operation, the jaws are brought into engagement with a wire wrapped about a terminal pin and squeezed, which squeezing tends to flatten or distort the helical wire wrap to relieve the force intermediate the wire wrap and the edges of the terminal pin. After such distortion and with the jaws still maintained clenched, an upward force applied to the pair of pliers will act through the bifurcated foot to lift the loosened wire wrap from the terminal pin.

The present invention may be described with greater specificity and clarity with reference to the following drawings, in which.

FIGS. *6a* and *6b* depict the resulting distortion of a helical wrapped wire disposed about a terminal pin rectangular in cross-section on use of the present invention; and FIGS. *7a* and *7b* depict a helically wrapped wire disposed about a terminal pin square in cross-section and illustrating the distortion of the wire wrap upon use of the present invention.

Figure 1:
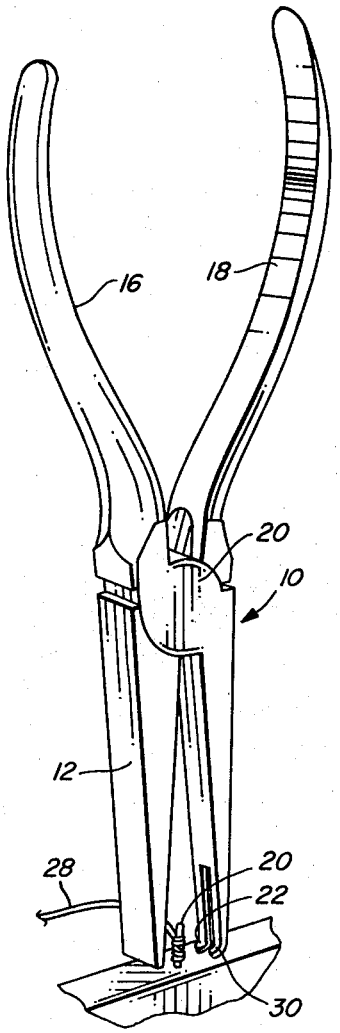
FIG. 1 is a perspective view of the present invention in operation.
Figure 2:
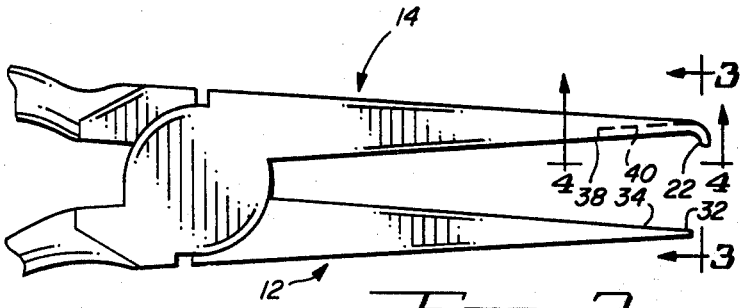
FIG. 2 is a side view of the jaws.
Figure 3:
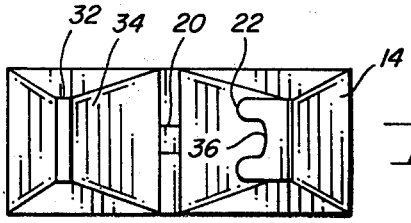
FIG. 3 is an end view taken along lines 3—3, as shown in FIG. 2.
Figure 4:
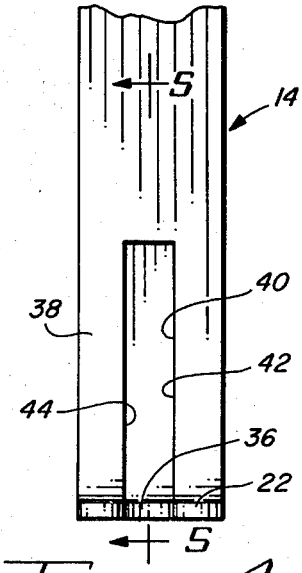
FIG. 4 is a side view taken along lines 4—4, as shown in FIG. 2.
Figure 5:
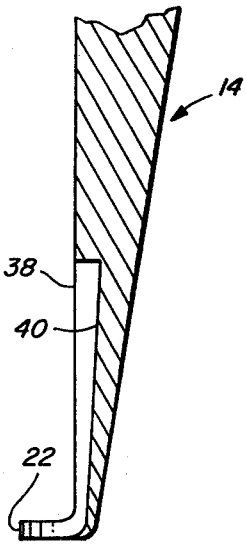
FIG. 5 is a cross-sectional view taken along lines 5—5, as shown in FIG. 4.
Figure 6A:
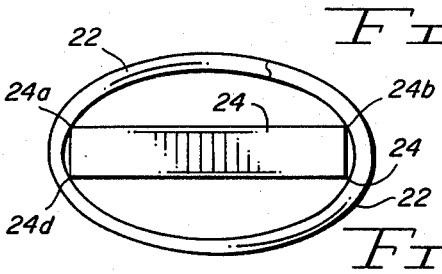
Figure 7A:
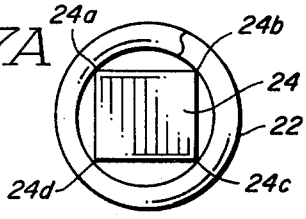
Figure 6B:
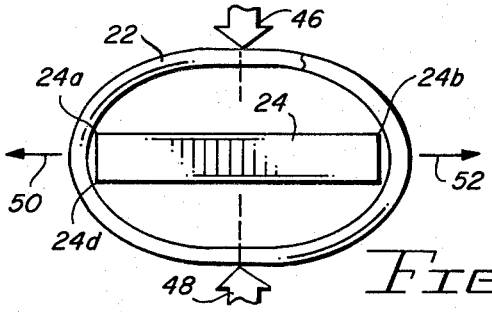
Figure 7B:
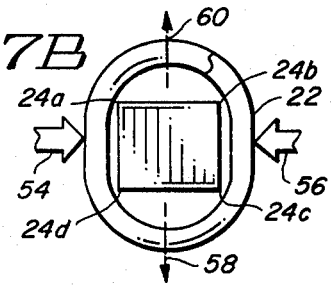

Referring to FIG. 1, there is shown a tool 10 configured as a plier-like device. The tool includes a pair of jaws 12, 14 which may be brought toward and away from one another by commensurate movement of interconnected handles 16 and 18 pivoting about a pivot point depicted generally by numeral 20. The tool is used to remove a wire wrap 22 around about a terminal pin 24 extending from a terminal board 26. Most wire wraps comprise a helix of an electrical wire 28 wrapped tightly about and in frictional engagement with a terminal pin. Such pins are usually rectangular or square in cross-section. The wire wrap itself is maintained upon the terminal pin by the friction attendant each wrap of the helix contacting each edge of the terminal pin. The wire wrap usually does not come into contact with the surface of the terminal pin intermediate adjacent edges.

Tool 10 is positioned with respect to terminal pin 24 so as to cause jaws 12 and 14 to be disposed adjacent opposed sides of the terminal pin. On squeezing of handles 16 and 18, the jaws are closed, which closing tends to squash the portion of the wire wrap adjacent the underlying sides of the terminal pin while simultaneously forcing laterally outwardly the orthogonally oriented opposed parts of the wire wrap. This resulting reconfiguration or deformation of the helical wire wrap substantially reduces the frictional contact intermediate the wire wrap and the edges of the terminal pin. A foot 30 disposed at the lower end of jaw 14 is positioned to straddle terminal pin 24 beneath the lower most part of wire wrap 22. After handles 16 and 18 have been squeezed resulting in deformation of the wire wrap, tool 10 is pulled upwardly which results in translation of a lifting force through foot 30 to wire wrap 22 to slidably disengage the wire wrap from the terminal pin. Such slidable disengagement is possible because of the above-described reduction in frictional contact therebetween. In addition, as the wire wrap is a helix the foot will lift the lower edge of the lowest coil and cause slight repositioning of each of the coils into a more horizontal plane; this will slightly enlarge the diameter of each coil. Thus, the formerly required unwrapping of the wire wrap is no longer necessary and very substantial time savings may be effected through use of tool 10.

Referring jointly to FIGS. 2, 3, 4 and 5, the details of jaws 12 and 14 will be described. Jaw 12 may be tapered to a point at tip 32; working surface 34 proximate tip 32 is essentially planar. Jaw 14 includes foot 30 which foot is slotted by slot 36; the width of the slot is preferably generally commensurate with the width of terminal pin 24 (see FIG. 1). Thereby, the foot is extendable beneath opposed sides of the wire wrap by receivingly placing terminal pin 24 within slot 36. Working surface 38 of jaw 14 may be planar, like working surface 34 of jaw 12. In a preferred embodiment, working surfaces 34 and 38 are parallel to one another and aligned with the respective sides of the terminal pin to apply a uniform pressure along the full length of the wire wrap on actuation of the tool. Thereby, all wraps are uniformly distorted and binding on removal of the wire wrap is avoided.

Alternatively, as shown in the drawings, a slot 40 may be disposed therein, which slot is concomitant with slot 36 in foot 30. Preferably, slot 40 is of a width the same as or close to that of the width of terminal pin 24. With the configuration, on engagement of jaw 14 with a wire wrapped terminal pin, edges 42 and 44 of slot 40 bear essentially against the resulting adjacent edges of the terminal pin.

The operative effect of tool 10 will be described with particular reference to FIGS. *6a* and *6b*. Normally, a wire wrap 22 defines a helix about a terminal pin 24, which pin is illustrated as being generally rectangular in cross-section. The wire wrap extends about the terminal pin to define an essentially oval or elliptical shape, which shape is dictated in part by the flexibility and deformability of the wire itself. Irrespective of the configuration of the oval, it is in frictional contacting engagement with the terminal pin essentially only at edges *24a*, *24b*, *24c* and *24d*. Usually the wire wrap is wound tightly enough to create a substantial amount of friction at these four points of contact to prevent sliding movement of the wire wrap along the longitudinal axis of the terminal pin upon application of any normally expected forces. For this reason, the prior art tools have been directed to devices for more or less easily unwrapping the wire wrap from about the terminal pin. Such procedure is time consuming and therefore labor intensive and expensive.

Referring particularly to FIG. *6b*, pair of arrows 46, 48 illustrate the force applied by tool 10 on engagement of jaws 12 and 14 with wire wrap 22 adjacent the indicated sides of the terminal pin. The resulting squeezing force tends to bring the adjacent segments of the wire wrap into closer contact with the underlying surfaces of terminal pin 24. This deformation results in outward expansion of the remaining segments of the wire wrap, as indicated by pair of arrows 50 and 52. The resulting deformation of wire wrap 22 also has the effect of reducing the frictional contact intermediate the wire wrap and corners *24a*, *24b*, *24c* and *24d*. The reduced frictional contact now allows the wire wrap to be slidably disengaged from the terminal strip by applying an upward force to tool 10, which upward force, acting through foot 30 will lift the wire wrap. It is to be understood that tool 10 may be operatively engaged with terminal pin 24 in the axis opposite to that shown in FIGS. *6a* and *6b* with equally satisfactory results.

FIGS. *7a* and *7b* illustrate the operative effect of tool 10 acting upon a terminal strip 24 square in cross-section and supporting an essentially circular helical wire wrap 22. Here also, corners 24*a*, 24*b*, 24*c* and 24*d* provide the supporting frictional contact intermediate the terminal pin and the wire wrap. On application of a force to the wire wrap, as indicated by arrows 54, 56, the circular wire wrap will be deformed into an oblong shape, as shown in FIG. *7b*. The change in configuration lessens the frictional force attendant the contact points along the edges of the terminal pin through the resulting expansion of the wire wrap in the direction indicated by arrows 58 and 60. Again, the wire wrap 22 may be withdrawn from the square shaped terminal pin by applying an upward force to tool 10 to cause foot 30 to slidably lift wire wrap 22 from terminal strip 24.

Foot 30 is preferably of sufficient extension and slot 36 is deep enough to permit the tangs of the foot to extend beneath a sufficient width of the wire wrap to apply a uniform lifting force thereacross. Were the tangs of foot 30 limited in extension, the lifting force might have the tendency of skewing the wire wrap, which skewing would increase the frictional contact with the terminal pin due to the misalignment resulting between the wire wrap and the terminal pin.

Should slot 40 not be formed within working surface 38 of jaw 14, the invention would still operate as described above. However, it has been found by experimentation that after an initial squeezing of the wire wrap, the squeezing pressure must be slightly reduced before the wire wrap can be readily lifted off. Were the squeezing pressure not reduced, the lift-off is more difficult than necessary. By employing slot 40, its edges 42 and 44 bear essentially against the corresponding edges of the terminal strip (in example, edges 24*b* and 24*c*) and for reasons not fully presently understood, a reduction in the squeezing force is not necessary prior to exerting a lifting force and minimal frictional contact intermediate the wire wrap and the terminal pin is still obtained. For these reasons, the configuration of jaw 14 illustrated is the preferred embodiment of the jaw.

While the principles of the invention have now been made clear in an illustrative embodiment, there will be immediately obvious to those skilled in the art many modifications of structure, arrangement, proportions, elements, materials and components, used in the practice of the invention which are particularly adapted for specific environments and operating requirements without departing from those principles.

I claim:

1. A tool for removing a helically wrapped wire from about a terminal pin without damaging the pin, said tool comprising in combination:

(a) a pair of jaws positionable toward and away from one another;

(b) a first jaw of said pair of jaws having a wedge shape tapering longitudinally and terminated by a flat end portion, said first jaw including a first planar working surface for contactingly engaging the wire wrap on a first side of the terminal pin;

(c) a second jaw of said pair of jaws including a second working surface having planar elements for contactingly engaging the wire wrap on a second side of the terminal pin diametrically opposed from the first side, said first and second working surfaces being oriented to effect positioning of said first and second working surfaces parallel to one another on contact with the wire wrap to apply uniformly distributed opposing forces to the wire wrap to squeeze it in one axis;

(d) a foot protruding perpendicularly from the terminal end of said second jaw toward said first jaw and extending beneath said end portion of said first jaw on closure of said pair of jaws, said foot being insertable beneath the wire wrap for lifting the wire wrap off the terminal pin on application of an upward force to said tool, said foot including a slot for receiving the terminal pin;

(e) a recess having parallel sides disposed within said second working surface and extending longitudinally along said second jaw for partially receiving the engaged side of the wire wrap, said recess being interconnected and aligned with said slot of said foot and extending therefrom along said second jaw; and (f) means for actuating said pair of jaws to squeeze the opposed first and second sides of the wire wrap toward one another whereby the configuration of the wire wrap is distorted to reduce frictional contact of the wire wrap with the terminal pin and permit sliding disengagement of the wire wrap from the terminal pin on application of the upward force of said tool.

* * * * *